United States Patent [19]

Vedenpää

[11] 4,441,263

[45] Apr. 10, 1984

[54] DEVICE IN THE DRYING SECTION OF A PAPER MACHINE

[75] Inventor: Timo Vedenpää, Jyväskylä, Finland

[73] Assignee: Valmet Oy, Finland

[21] Appl. No.: 276,334

[22] PCT Filed: Oct. 27, 1980

[86] PCT No.: PCT/FI80/00002

§ 371 Date: Jul. 20, 1981

§ 102(e) Date: Jun. 18, 1981

[87] PCT Pub. No.: WO81/01428

PCT Pub. Date: May 28, 1981

[30] Foreign Application Priority Data

Nov. 20, 1979 [FI] Finland ..... 793643

[51] Int. Cl.[3] ..... F26B 13/08

[52] U.S. Cl. ..... 34/115; 34/116; 34/123

[58] Field of Search ..... 34/114, 115, 116, 117, 34/123, 23

[56] References Cited

U.S. PATENT DOCUMENTS

| | | | |
|---|---|---|---|
| 3,320,677 | 5/1967 | Reitzel | 34/116 |
| 3,555,700 | 1/1971 | Wagner | 34/116 |
| 3,733,711 | 5/1973 | Haythornthwaite | 34/155 |
| 3,874,997 | 4/1975 | Kankaanpaa | 34/116 |
| 4,186,496 | 2/1980 | Beke et al. | 34/114 |
| 4,202,113 | 5/1980 | Kankaanpaa | 34/116 |
| 4,359,828 | 11/1982 | Thomas | 34/114 |

*Primary Examiner*—Larry I. Schwartz

*Attorney, Agent, or Firm*—Steinberg & Raskin

[57] ABSTRACT

A means in the drying section of a paper machine. The drying section comprises two rows of drying cylinders or rolls, one above the other. The web travels between these cylinders and rolls, meandering from one row to the other, all the time supported by a drying fabric. Herein, the web lies directly against the cylinder or roll surface in one row of cylinders or rolls and similarly the drying fabric is adjacent to the roll surface, while the web is on the outside, in the other row of cylinders or rolls. The means comprises a suction box (13) or a plurality of suction boxes, disposed to operate against the drying fabric (12). Said suction box (13) or suction boxes (13',13'') extend substantially over the entire length of the joint run of the web (W) and the drying fabric from one cylinder or roll to the other. In addition, the suction of said suction box (13;13';13'') also extends into the wedge space between the drying fabric (12) and the drying cylinder (11) or equivalent roll shell and in at least the suction box (13) on the entry side (17) of the drying fabric (12) and web (W) or the respective suction boxes, there are suction apertures through which the subatmospheric pressure prevailing therein acts in said wedge space (16,17,18,19).

6 Claims, 9 Drawing Figures

FIG. 6
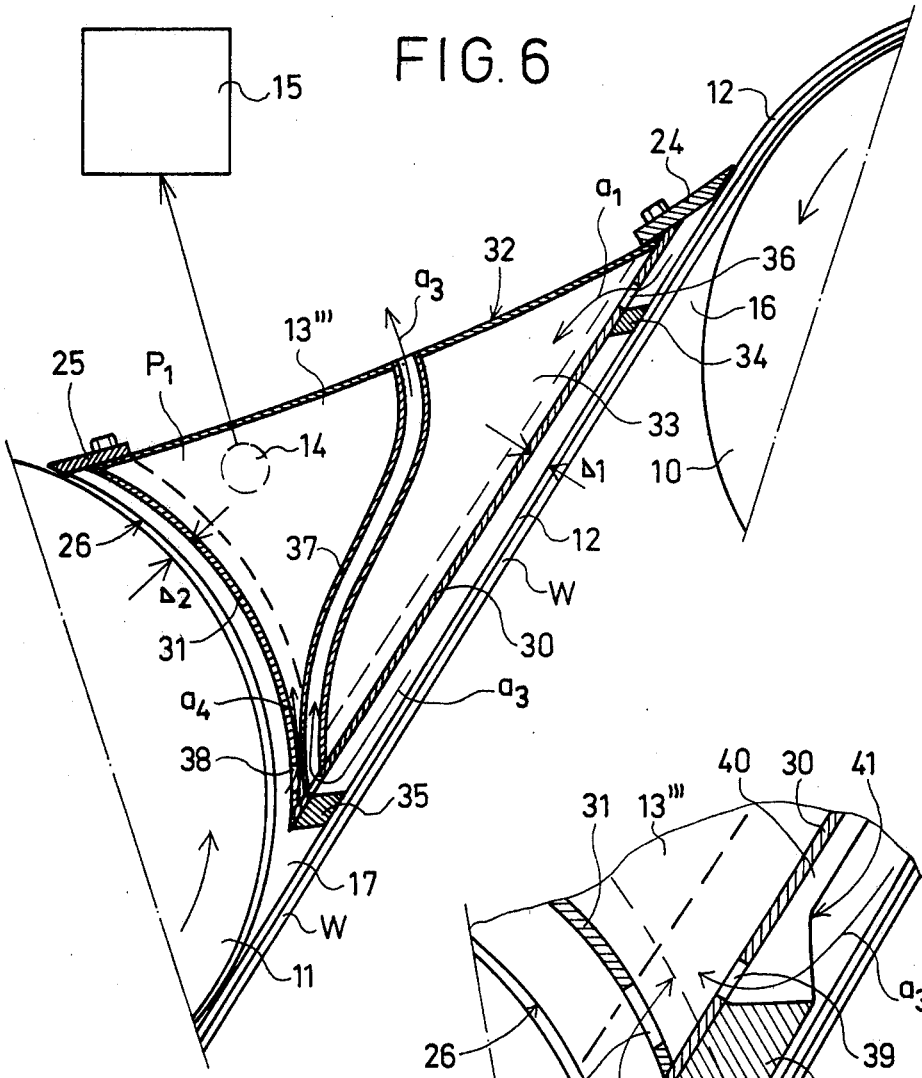
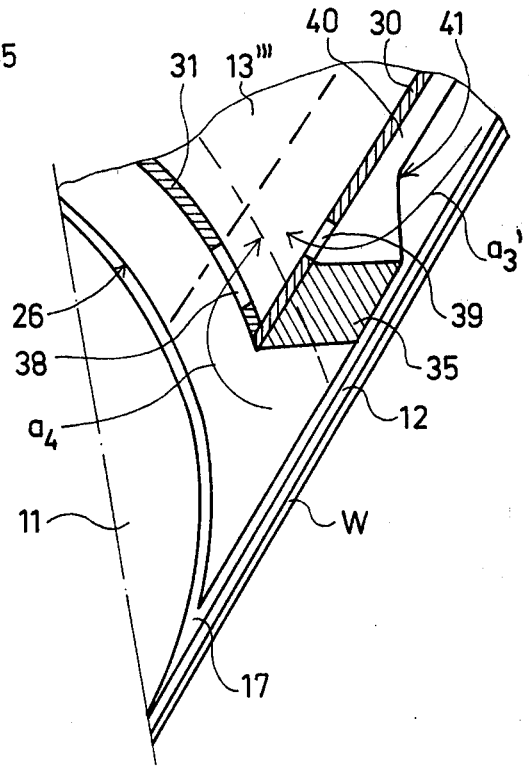
FIG. 7

DEVICE IN THE DRYING SECTION OF A PAPER MACHINE

BACKGROUND OF THE INVENTION

The present invention relates to a device in the drying section of a paper machine for running the web as a closed draw, which device operates in connection with a drying fabric arranged in such a way that one cylinder/several cylinders or roll/rolls of the drying section is/are outside the drying fabric loop and the other cylinder/cylinders or roll/rolls is/are inside the drying fabric loop so that the web passes from one cylinder or roll to the other cylinder or roll over the whole distance supported by said fabric.

Regarding the state of art, reference is made to Finnish patent applications Nos. 761953 and 771056, which correspond to U.S. Pat. Nos. 4,183,148 and 4,202,113 respectively, assigned to applicant's assignee, to Finnish Pat. No. 54954 corresponding to U.S. Pat. No. 4,172,007 also assigned to applicant's assignee, and to the Finnish patent application No. 780833 of J. M. Voith GmbH (related DE-GM No. 7 708 630).

The Finnish patent application No. 761953 corresponding to U.S. Pat. No. 4,183,148 discloses a procedure for providing a closed paper web draw in the beginning of the multicylinder dryer that comprises two rows of drying cylinders preferably one on top of the other. The first part of one of the rows, preferably the top row, is enclosed within the first wire or felt that supports the wire as it passes from one cylinder row to the other so that the web is, when being in association with one cylinder row, on top of said felt or wire, and when being in association with the cylinders of the other cylinder row, between the felt or wire and the surface of the cylinders of the row in question. In the procedure depicted above, the essentially new feature is that, in order to hold the web on the surface of the cylinders of that cylinder row whose cylinders are enclosed within the first wire or felt, at this point, another wire or other wires, preferably of a coarse-meshed type and essentially of the width of the web, is/are passed on the web, in order to press the web on the sector on which the web touches said cylinders, at the most, and that, in order to prevent friction between the wire or felt and the wire and the consequent dusting of the wire, the angular speed of the second wire or felt in relation with center points of the drying cylinders in question, is arranged to be automatically adjusted to be the same as the angular speed of the web that runs on these cylinders.

The Finnish patent application No. 771056 corresponding to U.S. Pat. No. 4,202,113 mentioned above discloses a procedure in the drying section of a paper machine for guiding the web as a closed draw, in which procedure, in the beginning of the drying section, particularly in its first group of drying cylinders, a drying wire or fabric is used which is arranged in such a way that the cylinders of one row are outside the fabric loop and the cylinders of the other row are within the fabric loop so that the web runs zig-zag from one cylinder row to the other at all times supported by the same fabric, from the beginning to the end of the drying cylinder group that is equipped with said fabric. An essentially new feature in this known method is that, at least at some of the cylinders at which the web is outside the fabric, a pressure-difference is, via the grooved surfaces of these cylinders, applied to the web so as to make the pressure outside the web higher as compared with the pressure in the grooves of the cylinder surface, particularly for preventing the web from separating from the fabric and for ensuring the continuous operation of the paper machine.

In said Finnish Pat. No. 54954 corresponding to U.S. Pat. No. 4,172,007 a procedure is disclosed for ensuring the draw of the web from the press section to the drying section, in which procedure the main new feature is that between the drying cylinder group and the press section there is a separate lead drying cylinder that does actually not belong to this group; that, for holding the web in contact with said bottom drying belt as it runs around the top cylinders of said special cylinder group, an overhead drying belt, essentially of the width of the web, is passed onto the web in order to press the web against the bottom drying belt over a sector that is essentially narrower than the sector at which the bottom drying belt supporting the web covers the top cylinders; and that said overhead drying belt can be made to touch the lead drying cylinder by means of an adjustably positionable lead roll at least for the phase during which the web, when the paper machine is started, is transferred from the press section to the drying section.

In the above-mentioned Finnish patent application No. 780833 of J. M. Voith GmbH a paper machine drying section is disclosed, wherein in the wedge-shaped space between the drying belt and drying cylinder at the entry side and/or at the exit side there is an air lock essentially reaching over the whole length of the drying cylinder in such a way that the penetration of air into said wedge-shaped spaces is prevented.

With the known device described above it is not possible to completely prevent the web from separating the drying belt and consequent web ruptures.

In the above-mentioned procedures and devices, in which the web follows the drying fabric in such a way that, at the bottom cylinders or similar of the drying cylinder group, the web will be the outermost element, the web tends, due to air currents and centrifugal forces, to separate from the drying fabric. The risk of such separation mainly increases with the square of the web speed. Another important reason why the web tends to separate from the drying fabric is that the drying cylinder and the drying fabric induce an air flow that tends to separate the web from the drying fabric. Another drawback related with these facts is that air enters between the drying fabric and the drying cylinders which reduces thermal conduction. At current web speeds it has been possible to eliminate these problems by using suitable felt. As the machine speeds have increased, it has not entirely been possible to avoid said phenomena.

SUMMARY OF THE INVENTION

For preventing the drawbacks mentioned above and for attaining the objectives of the invention, the principal characteristic feature of the invention is that the device comprises a suction box or boxes, which are arranged to function against the drying fabric essentially on the whole length of the common draw of the web and the drying fabric from one roll to the other, and that the suction of said suction box is arranged to reach the wedge-shaped space between the drying fabric and the drying cylinder or roll shell at least at the exit side of the machine.

The operation of a device in accordance with the invention is based on the control of air currents and a suitable use of vacuum. In a device in accordance with the invention the suction box is made extend over the whole draw space to the felt side. The device comprises air guiding baffles arranged and shaped to minimize harmful air currents by deflecting them from their direction. The device of the invention also produces a differential pressure over the web and the felt so that the web is urged against the felt. In the invention, a differential pressure is provided within the closing gorge between the felt and the lower cylinder whereby the felt is maintained at subatmospheric pressure, and the pressure difference also has an influence on the arc of the lower cylinder, as with currently used dry matter contents, the web produced with high-speed machines is almost impervious at the pressure differences in question. It is therefore sufficient that an apparatus in accordance with invention be installed only at the side of said closing gorge. The effectiveness of the invention may be improved by using as the cylinder/roll a groove-surfaced or pitted member, in which case also the gorge opening between the lower cylinder and the felt is preferably covered or under suction.

A device in accordance with the invention should preferably extend over the whole width of the web, but the device may be divided in the cross-machine direction into separate compartments for ensuring the initial web transfer or threading. It may also be necessary, at the exit side, to apply the suction on the web end transfer strip only.

In a device in accordance with the invention the distribution of pressure should preferably be arranged in such a way that the pressure difference is at its maximum at the critical points, viz. on the cylinders, and at its minimum on a free run of the web. This is for minimizing the pressure-energy requirements and reducing the curvature of the felt in the draw, which might cause friction and felt attrition, or necessitate special structures in order to prevent said curvature.

An apparatus in accordance with the invention has the advantage that it features an uncomplicated construction and provides for good support at the free draws of the web. Another advantage is an easier transfer of the web. An apparatus in accordance with the invention is also easy to remove from the machine. The vacuum on the periphery of the cylinder contributes to the evaporation of water from the web and improves the thermal conduction between the web and the cylinder.

DESCRIPTION OF THE DRAWINGS

Embodiments of the invention will now be described in detail, with reference to the accompanying drawings, with no intention to restrict the invention to these details.

FIG. 6 illustrates an embodiment of the invention in accordance with FIGS. 3,4 and 5, in which there is a particular air-removal channel and specially shaped sealing strips of doctor-blade type acting against the drying fabric.

FIG. 7 is an alternative embodiment of detail $A_3$ in FIG. 6.

DESCRIPTION OF THE PREFERRED EMBODIMENTS

The figures illustrate a part of the multicylinder dryer of a paper machine, said multicylinder dryer comprising drying cylinders 10,11 heated by means of steam, electricity or in some other conventional way. The drying cylinders are located in two rows, of which the upper row comprises drying cylinders 10 and of which the lower row comprises drying cylinders 11. Over the drying cylinders passes drying fabric 12, hereinafter referred to as the felt, though it must be emphasized that, instead of a felt, the invention may make use of a similar fabric such as drying wire or some other similar belt. Web W runs, supported by felt 12, in a zig-zag from one row of cylinders to the other in such a way that, on upper cylinders 10, web W is between felt 12 and the heated surface of cylinders 10, and on lower cylinders 11, felt 12 is situated against the heated surface of the cylinder the web W is outside of the felt. Thus cylinders 10 of the upper row are located outside the loop of felt 12, and cylinders 11 of the bottom row are enclosed within the loop.

Figure 1:
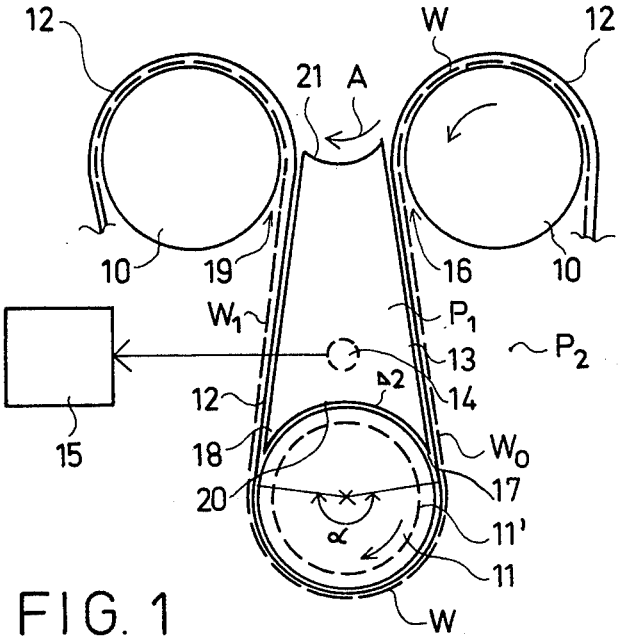
FIG. 1 is a schematic side view of an apparatus in accordance with the invention comprising a suction box installed between the drying cylinders.
Figure 2:
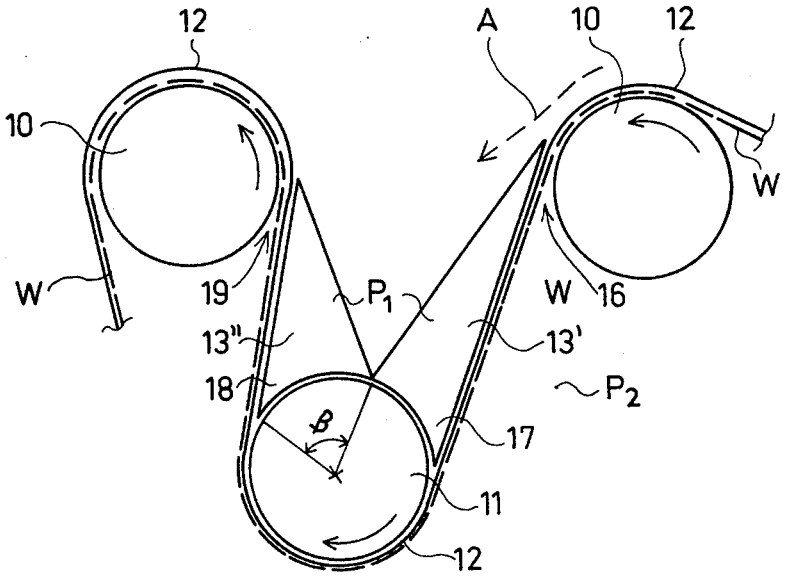
FIG. 2 illustrates an embodiment of the invention in which there are two separate suction boxes between the drying cylinders.

As shown in FIGS. 1 and 2, suction boxes 13,13',13" are arranged between the cylinders so as to operate against the surface of felt 12, said suction boxes thus being located within the loop of felt 12. The suction box 13 of FIG. 1 has against the outer surface of cylinder 11 a closed wall 20, and between cylinders 10 there is a curved wall 21 which functions to direct air in the direction of arrow A. The suction box 13 has suction slots through which suction is mainly applied to wedge-shaped spaces or gorges 16,17,18 and 19 between cylinders 10 and 11 and felt 12.

As shown in FIG. 1, at cylinder 10 web W is interposed between felt 12 and cylinder 10, and at cylinder 11 web W is in the outermost position. Suction box 13 is installed and the pressures adjusted so that pressure: $P_1 < P_2 (\simeq 1$ aty). Suction box 13 is so constructed as to provide the highest subatmospheric pressures at spaces 16,17 and 18. Top wall 21 of suction box 13 directs the air current A such that it will not cause the web W to separate from felt 12 at space 16. A high vacuum also draws web W into contact with felt 12 in pit 16, and a lower vacuum holds the web at the central section of the draw $W_0$. In gorge 17, a high vacuum draws web W firmly against felt 12 and creates a subatmospheric pressure in the felt, which due to the imperviousness of web W, is maintained over the whole arc $\alpha$, and in gorge 18 a high vacuum draws web W against felt 12, and in area $W_1$ a lower vacuum serves to insure transfer of web W into the gorge 19.

Cylinder 11 may either be a recessed-surface or smooth-surface cylinder, in which latter case felt 12 must have a certain pore volume. The recessed surface of cylinder 11 is illustrated with phantom line 11'. The subatmospheric pressure $P_1$ prevailing in suction box 13 is provided by the schematically shown pump 15 and connection 14, known as such.

The apparatus illustrated in FIG. 2 is substantially similar to the apparatus illustrated in FIG. 1 except that suction box 13 is constructed of two separate parts 13' and 13". Suction box 13' can also be used alone, i.e., without box 13". In this case, should cylinder 11 be grooved, sector $\beta$ should then preferably be perforated.

Suction boxes 13,13' and 13" can either be as wide as the entire web W or they can be only as wide as the main draw or pull-in strip.

Boxes 13,13',13", illustrated in FIGS. 1 and 2, may, in the transverse or cross-machine direction, be divided into two or more compartments, such division being advantageous in the pulling in of the end of web W. In certain cases it is also advantageous to apply a higher vacuum to the edges or margins of web W through the use of said division in compartments.

Figure 3:
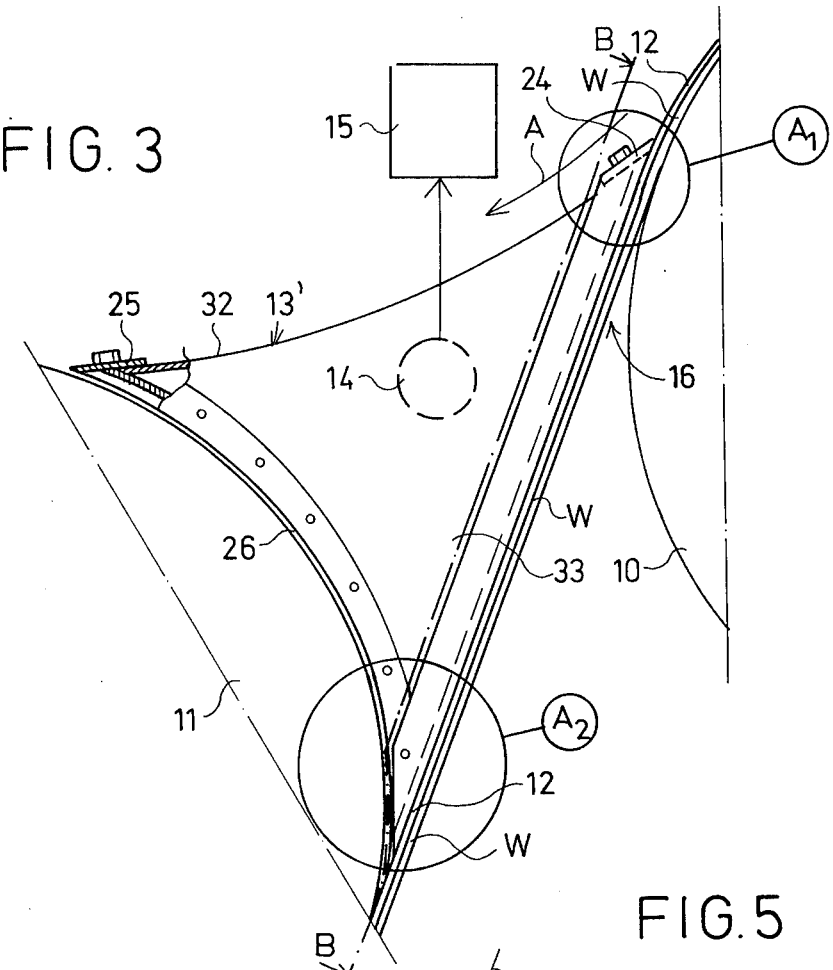
FIG. 3 illustrates an embodiment of the invention in which the suction box is located in the wedge-shaped converging space at the entry or incoming side of the drying fabric and the web.
Figure 4:
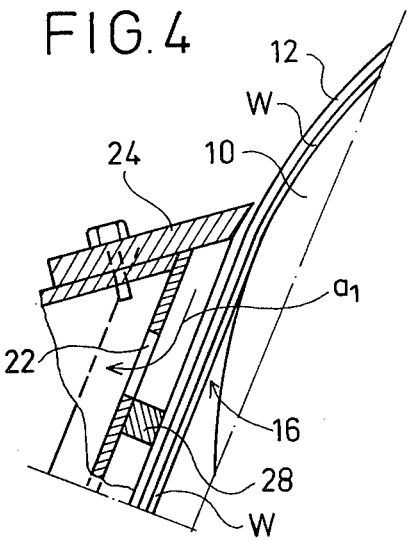
FIG. 4 illustrates detail $A_1$ in FIG. 3.
Figure 5:
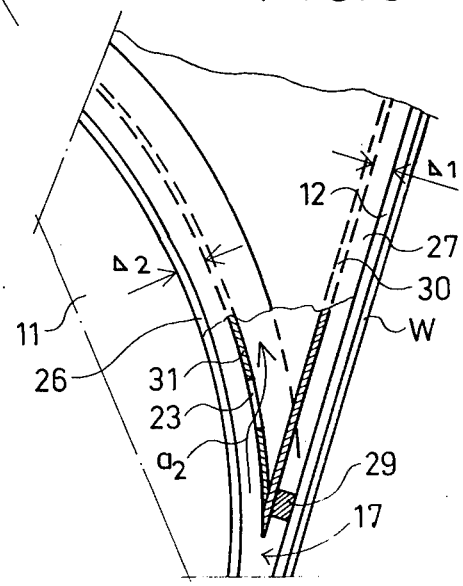
FIG. 5 illustrates detail $A_2$ in FIG. 3.

FIGS. 3,4 and 5 show one possible embodiment of the construction of the suction box 13. The suction box is provided with openings 22 and 23 through which a subatmospheric pressure is produced both on cylinder 10 into the separation angle of space or gorge 16 and on cylinder 11, into the closing angle of space or gorge 17. The extent of openings 22,23 can be adjusted for instance by means of a slide mechanism, and may be different in size at different points over the transverse breadth of the web. Sealing strips 24 and 25 prevent the induction of an air current along with cylinders 10 and 11. At least seal 24 should be of resilient construction. Curved gable or end seals 26 prevent air flow in the direction of the cylinder axis as due; seals 27 located at each end of suction box 13. Seals 28 and 29 prevent the vacuum from spreading into the center area of the draw of felt 12 between cylinders 10 and 11.

Suction box 13' borders upon a planar wall 30 which is at distance $\Delta_1$ from the inner surface of felt 12, upon a curved wall 31 which is at distance $\Delta_2$ from the surface of cylinder 11, upon outer wall 32 connecting walls 30 and 31, and upon two gables or end walls 33.

FIG. 6 illustrates one alternative embodiment of the construction of suction box 13'''. Seals 34 and 35 are now bevelled to have a rhombic shape to resemble a doctor blade, and suction opening 36 is located just in front of seal 34 to ensure a maximum flow, designated $a_1$. Felt 12 always induces a small air current $a_3$ that follows the felt into the slot or gap area between wall 30 and felt 12. The effects of air current $a_3$ are, as shown in FIG. 6, eliminated by directing the flow of air current $a_3$ through a tube 37. Air flow $a_3$ can be so directed as to make air flow $a_4$, exiting from the converging space 17 through opening 38, eject air flow $a_3$.

In the alternative illustrated in FIG. 7, a hole 39 is substituted for tube 37. The seal 35 guides air flow $a_3'$-through hole 39 to discharge into the interior of box 13''' which is at subatmospheric pressure $P_1$. In the case it is desired to have only a minimal vacuum at the central area of the felt draw, gable or end seals 40, located at the central region further away from the felt 12, of a shape shown in FIG. 7, can be used. The shape of edge 41 of seal 40 can for instance be selected so to follow the curved shape of the edge area of felt 12, said curved shape resulting from the pressure differential.

Figure 8:
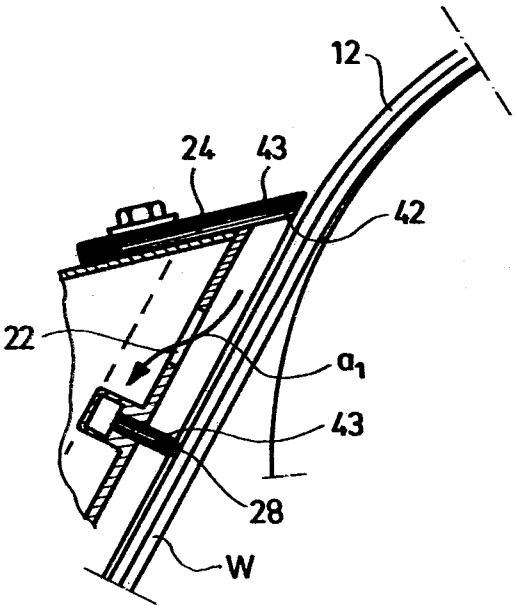
FIG. 8 illustrates a modification of the structure illustrated in FIG. 4, i.e., of the detail $A_1$ of FIG. 3.

FIG. 8 illustrates a modified arrangement of the detail $A_1$ of FIG. 3 wherein the sealing strip 24 has a ribbed configuration 42 which affords rigidity to the seal. The sealing strip also includes a film 43 for tight sealing.

Figure 9:
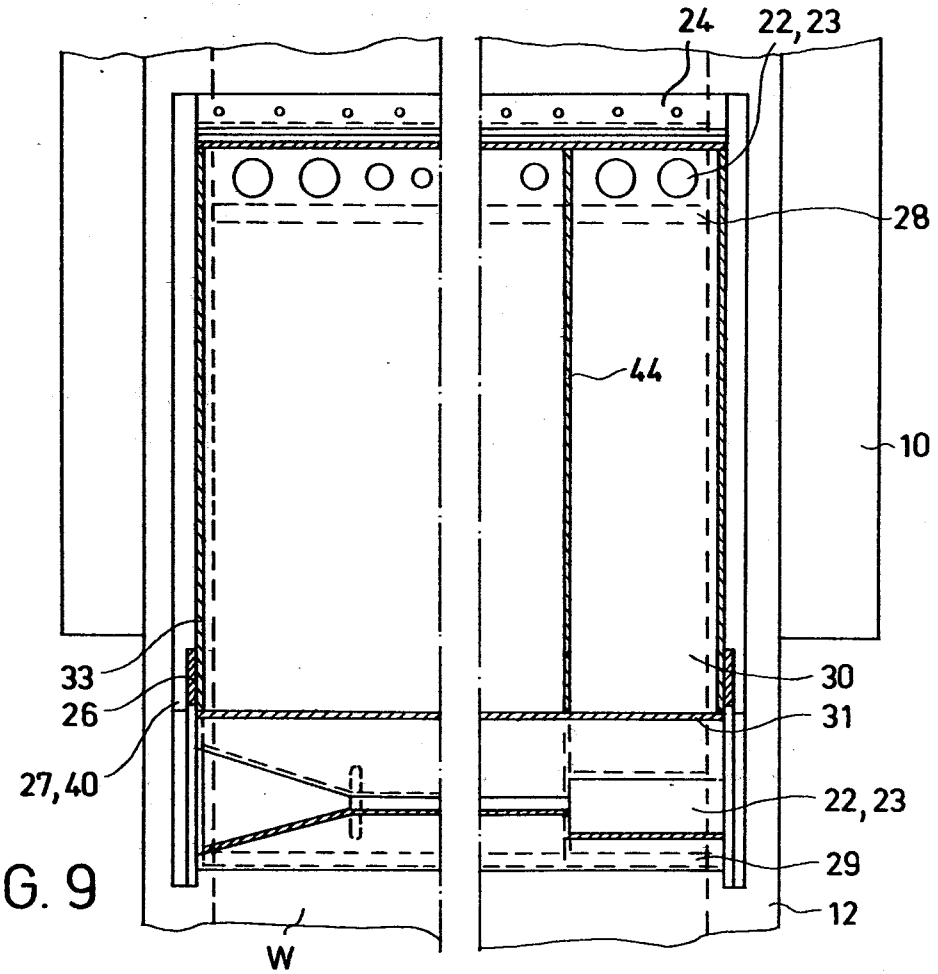
FIG. 9 is a section view taken along line B—B of FIG. 3.

FIG. 9 is a section taken along line B—B of FIG. 3 and illustrates the division of the suction box into separate transverse suction chambers by partition 44 which may be individually connected to appropriate vacuum sources through apertures 22, 23.

As shown in FIG. 1, cylinder 11 of the lower row is equipped with recessed-surface shell 11'. As a subatmospheric pressure is produced in the cavities of this shell 11' through wedge-shaped spaces 17 and/or 18 as described above, the subatmospheric pressure acts on the entire sector $\alpha$, since at the moisture contents encountered in practice, the paper web W is virtually impervious. This contributes to the prevention of web W from separating on sector $\alpha$ due to centrifugal forces and other factors. The grooving of shell 11' may encircle the shell of roll 11, such as by winding profiled tape around the shell. Should one wish to use recessed surface 11 in such applications wherein the shell of the roll is not covered or equipped with a suction box on a sector extending outside of the borders of sector $\alpha$, axial grooves or blind perforations can be substituted for said wound grooving.

The various details of the invention may vary within the framework of the scope of the invention as defined in the following claims.

I claim:

1. In a drying section of a paper machine including drying cylinders and a drying fabric loop arranged such that a first group of at least one of said cylinders is located outside of said drying fabric loop and a second group of at least one of said cylinders is located within said drying fabric loop, so that the web runs in a closed draw in a joint run with and supported by said fabric from a cylinder of one group to a cylinder of the other group, said joint run defining wedge-shaped spaces between said drying fabric and the shell of the drying cylinders, the improvement comprising at least one suction box situated adjacent to a joint run of said web and drying fabric, said suction box including suction apertures situated proximate to at least one of said wedge-shaped spaces to produce a suction effect mainly in said at least one of said wedge-shaped spaces, said at least one suction box thereby constituting means for producing a suction effect mainly in at least one of said wedge-shaped spaces, said suction effect being substantially higher than a suction effect, if any, produced by said suction box in the region of said closed draw run of said web between said wedge-shaped spaces, wherein said at least one suction box includes a substantially closed, planar wall, situated adjacent to said closed draw run of said web between said wedge-shaped spaces, wherein longitudinal seals are provided at each lateral side of said suction box in operative relation with and extending in the direction of the closed draw run of said web between said wedge-shaped spaces, and wherein transverse seals project from said closed wall proximate to said wedge-shaped spaces in operative relation with and extending transverse to the direction of the closed draw run of said web between said wedge-shaped spaces, said transverse seals acting to inhibit the production of a subatmospheric pressure in a central region of the closed draw run, and said seals guiding said drying fabric at a distance from said substantially planar wall.

2. The combination of claim 1 wherein said suction apertures are situated in the region of said transverse seals.

3. The combination of claim 1 wherein said transverse seals are rhombic in cross-section.

4. The combination of claim 1 wherein said suction box further includes a tube communicating with a space between said closed draw run of said web and said planar wall of said suction box.

5. In a drying section of a paper machine including drying cylinders and a drying fabric loop arranged such that a first group of at least one of said cylinders is located outside of said drying fabric loop and a second group of at least one of said cylinders is located within said drying fabric loop so that the web runs in a closed draw in a joint run with and supported by said fabric from a cylinder of one group to a cylinder of the other group, said joint run defining wedge-shaped spaces between said drying fabric and the shell of the drying cylinders, the improvement comprising at least one suction box situated adjacent to a joint run of said web and drying fabric, said suction box including suction apertures situated proximate to at least one of said wedge-shaped spaces to produce a suction effect mainly in said at least one of said wedge-shaped spaces, said at least one suction box thereby constituting means for producing a suction effect mainly in at least one of said wedge-shaped spaces, said suction effect being substantially higher than a suction effect, if any, produced by said suction box in the region of said closed draw run of said web between said wedge-shaped spaces, wherein said cylinders defining said wedge-shaped spaces each include a respective shell having a recessed surface, wherein said suction effects produced in said wedge-shaped spaces are communicated into said recessed surfaces to facilitate maintenance of the web in contact with the outer surface of the drying fabric as it curves over a sector of the cylinder, and wherein said recessed surface comprises axial grooves formed in each of said shells whereby the sector of said shell outside the sector thereof which is lapped by the drying fabrics, communicates with ambient pressure.

6. In a drying section of a paper machine including drying cylinders and a drying fabric loop arranged such that a first group of at least one of said cylinders is located outside of said drying fabric loop and a second group of at least one of said cylinders is located within said drying fabric loop, so that the web runs in a closed draw in a joint run with and supported by said fabric from a cylinder of one group to a cylinder of the other group, said joint run defining wedge-shaped spaces between said drying fabric and the shell of the drying cylinders, the improvement comprising at least one suction box situated adjacent to a joint run of said web and drying fabric, said suction box including suction apertures situated proximate to at least one of said wedge-shaped spaces to produce a suction effect mainly in said at least one of said wedge-shaped spaces, said at least one suction box thereby constituting means for producing a suction effect mainly in at least one of said wedge-shaped spaces, said suction effect being substantially higher than a suction effect, if any, produced by said suction box in the region of said closed draw run of said web between said wedge-shaped spaces, wherein said suction box is divided transversely into a plurality of compartments located in side-by-side relationship, each of said compartments producing a vacuum, and wherein the vacuum produced in said compartments nearest to the lateral sides of the fabric is higher than the vacuum produced in other ones of said compartments.

* * * * *